US009547273B2

(12) United States Patent
Ito et al.

(10) Patent No.: US 9,547,273 B2
(45) Date of Patent: Jan. 17, 2017

(54) IMAGE FORMING APPARATUS HAVING SIMULTANEOUS DEVELOPMENT AND CLEANING

(71) Applicant: CANON KABUSHIKI KAISHA, Tokyo (JP)

(72) Inventors: Motonari Ito, Suntou-gun (JP); Motoki Adachi, Ashigarakami-gun (JP); Satoshi Sunahara, Hachioji (JP); Kuniaki Tamagaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/733,082

(22) Filed: Jun. 8, 2015

(65) Prior Publication Data

US 2015/0362886 A1 Dec. 17, 2015

(30) Foreign Application Priority Data

Jun. 13, 2014 (JP) ..... 2014-122463

(51) Int. Cl.
*G03G 15/02* (2006.01)
*G03G 21/10* (2006.01)
*G03G 15/00* (2006.01)

(52) U.S. Cl.
CPC ..... *G03G 21/10* (2013.01); *G03G 15/0233* (2013.01); *G03G 15/505* (2013.01); *G03G 2215/025* (2013.01)

(58) Field of Classification Search
CPC .. G03G 21/10; G03G 15/0233; G03G 15/505; G03G 2215/025
See application file for complete search history.

(56) References Cited

U.S. PATENT DOCUMENTS 4,967,231 A * 10/1990 Hosoya ..... G03G 13/08 361/221
5,321,471 A 6/1994 Ito et al.
5,477,006 A * 12/1995 Imamiya ..... G03G 15/0806 399/285
5,517,289 A 5/1996 Ito et al.
(Continued)

FOREIGN PATENT DOCUMENTS

EP 0 863 447 A2 9/1998
JP H10213945 A 8/1998
(Continued)

OTHER PUBLICATIONS

European Search Report dated Nov. 10, 2015, in related European Patent Application No. 15171579.4.

*Primary Examiner* — David Gray
*Assistant Examiner* — Geoffrey T Evans
(74) *Attorney, Agent, or Firm* — Fitzpatrick, Cella, Harper & Scinto

(57) ABSTRACT

When an outer diameter of a charging member is defined as Hc, a ratio of the circumferential velocity of the charging member to the circumferential velocity of an image bearing member is defined as Rc, an outer diameter of a developer bearing member is defined as Hd, and a ratio of the circumferential velocity of the developer bearing member to the circumferential velocity of the image bearing member is defined as Rd, the relationship Hc/Rc≥Hd/Rd is satisfied.

12 Claims, 6 Drawing Sheets

(56) References Cited

U.S. PATENT DOCUMENTS 5,634,179 A * 5/1997 Umeda ..... G03G 15/0216 399/174
5,915,150 A * 6/1999 Kukimoto ..... G03G 9/0819 399/149
5,994,019 A * 11/1999 Okado ..... G03G 13/025 430/108.6
6,035,171 A * 3/2000 Takaya ..... G03G 15/0815 399/281
6,118,965 A * 9/2000 Hirabayashi ..... G03G 15/0241 399/175
6,928,253 B2 8/2005 Ojima et al.
7,043,175 B2 * 5/2006 Komoto ..... G03G 5/08214 399/149
7,058,338 B2 6/2006 Ojima et al.
7,251,441 B2 7/2007 Hagiwara et al.
2002/0009661 A1 * 1/2002 Hashimoto ..... G03G 9/0819 430/106.1
2002/0106216 A1 8/2002 Ishiyama et al.
2004/0022558 A1 * 2/2004 Okano ..... G03G 15/0208 399/175
2004/0038142 A1 * 2/2004 Yoshida ..... G03G 9/0819 430/108.6
2005/0111881 A1 5/2005 Arimitsu et al.
2014/0016952 A1 * 1/2014 Matsuda ..... G03G 15/75 399/26
2014/0016953 A1 * 1/2014 Yoshida ..... G03G 15/55 399/26
2015/0234315 A1 * 8/2015 Adachi ..... G03G 21/1803 399/283
2015/0362885 A1 * 12/2015 Iwayama ..... G03G 21/0094 399/53
2016/0054676 A1 * 2/2016 Usui ..... G03G 15/065 399/149

FOREIGN PATENT DOCUMENTS

JP 2880356 B2 4/1999
JP 4510493 B2 7/2010

* cited by examiner

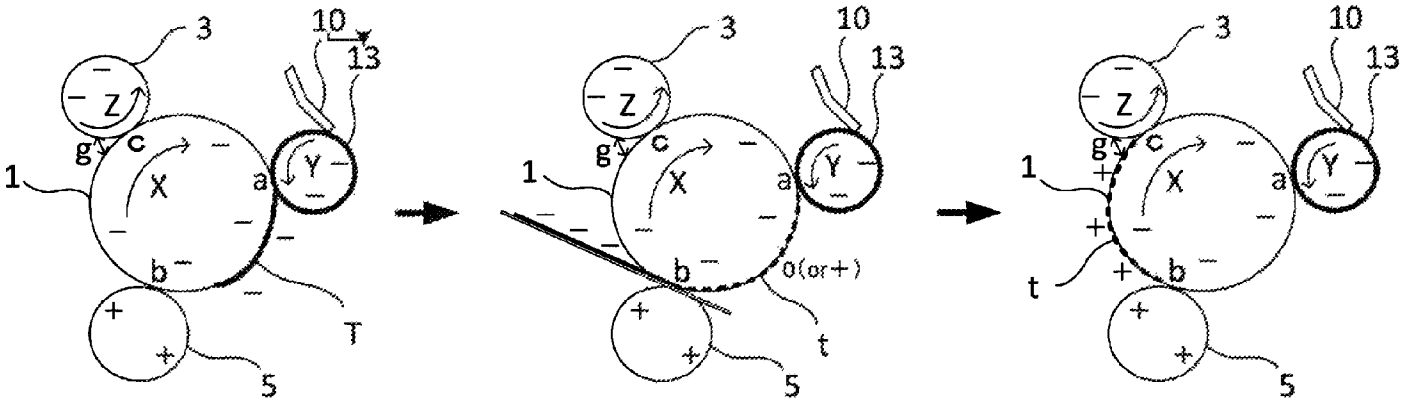
FIG.3A
FIG.3B
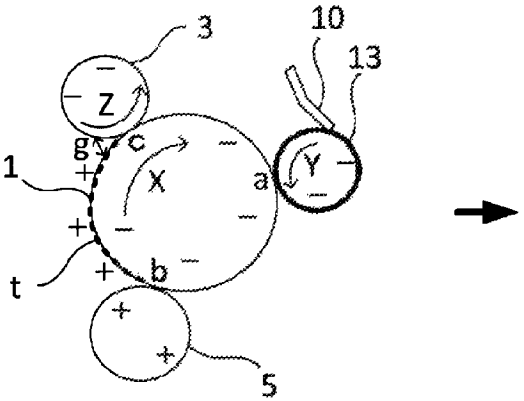
FIG.3C
FIG.3D
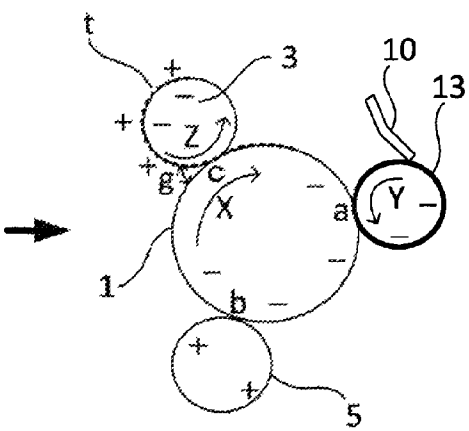
FIG.3E
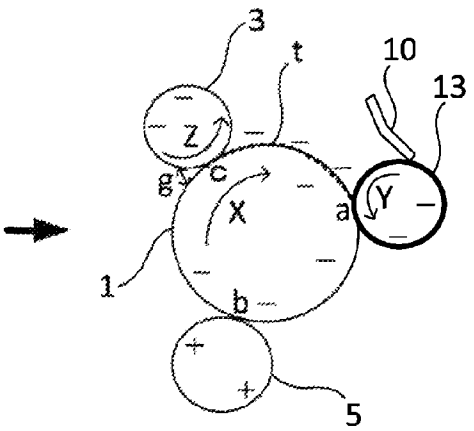
FIG.3F

IMAGE FORMING APPARATUS HAVING SIMULTANEOUS DEVELOPMENT AND CLEANING

BACKGROUND OF THE INVENTION

Field of the Invention

The present invention relates to an image forming apparatus.

Description of the Related Art

Cleaner-less systems (toner recycling systems) have previously been proposed for use in image forming apparatuses such as electrophotographic apparatuses or electrostatic recording apparatuses from the viewpoint of simplifying apparatus configuration and eliminating waste. In image forming apparatuses using a cleaner-less system, a drum cleaner that cleans the surface of the photosensitive drum following the transfer step is not provided, and untransferred toner on the photosensitive drum following the transfer step can be collected and reused as a result of carrying out so-called "simultaneous development and cleaning". Simultaneous development and cleaning is carried out by collecting untransferred toner on the photosensitive drum following the transfer step with a fog removal bias (fog removal potential difference Vback, which is potential difference between direct current voltage applied to the developing apparatus and surface potential of the photosensitive drum) during development in the next and subsequent steps. According to this method, since untransferred toner is returned to the developing apparatus and reused in the next and subsequent steps, waste toner can be eliminated and the bother of performing maintenance can be reduced. In addition, as a result of being cleaner-less, there are also considerable advantages in terms of space, enabling the size of image forming apparatuses to be greatly reduced.

A contact DC charging system, in which the surface of the photosensitive drum is uniformly charged to inhibit the generation of ozone by allowing an electrically conductive charging apparatus to make direct contact instead of a corona charging device, has been proposed for use as a charging apparatus used in image forming apparatuses using a cleaner-less system (Japanese Patent Application Publication No. H10-213945). In this system, a DC bias is applied to a charging roller serving as a charging apparatus, the charging roller uniformly discharges while rotating and making contact with the surface of the photosensitive drum, and this causes the surface of the photosensitive drum to become uniformly charged. At the same time, residue toner remaining on the surface of the photosensitive drum after the transfer step when the residue toner has entered a charging zone, and the residue toner can be effectively collected in the developing apparatus due to the fog removal bias generated during development. In a contact DC charging system, there is the risk of residue toner unable to have been completely charged in the charging zone ending up adhering to the charging roller thereby resulting in defective charging. Therefore, as a result of driving and rotating the charging roller and photosensitive drum by providing a prescribed difference in circumferential velocity between the respective surfaces thereof, toner can be made to have negative polarity due to rubbing between the surface of the charging roller and the surface of the photosensitive drum. As a result, adhesion of toner to the charging roller can be inhibited.

In addition, a one-component contact development system has been proposed for use as the developing apparatus in image forming apparatuses using a cleaner-less system (Japanese Patent No. 4510493). In this system, development is carried out by retaining developer on the developing roller which contacts with the surface of the photosensitive drum. The developing roller is uniformly coated in a thin layer with toner supplied from the developing chamber. A regulating blade arranged in contact with the developing roller imparts a charge to the toner due to triboelectric charging between the regulating blade and the developing roller. As a result of DC bias being applied to the developing roller and the potential difference between the developing roller and the photosensitive drum, an electrostatic latent image of the surface of the photosensitive drum is developed. In addition, as described in Japanese Patent No. 2880356, the circumferential velocity of a developing roller is typically set higher than the circumferential velocity of a photosensitive drum to facilitate migration of residue toner charged by the charging roller from the drum to a developing roller.

SUMMARY OF THE INVENTION

In the above-mentioned one-component contact development system, nearly 100% of the toner on the developing roller migrates to the photosensitive drum during printing of solid images. Consequently, since subsequent toner coated on the developing roller is only rubbed once by the regulating blade, it is unable to retain an adequate charge. As a result, in the case in which the next image has a white background, toner not having an adequate charge ends up migrating to the photosensitive drum resulting in fogging. This phenomenon is hereinafter referred to as post-black fogging. Post-black fogging occurs over the width of the developing roller in the case of having printed a solid image in a portion of the circumferential direction of the developing roller, or occurs over one rotation of the developing roller in the case of having printed a solid image for one rotation or more of the developing roller. Here, FIG. 6 is a graph indicating the relationship between the number of times toner in a developing apparatus has passed the regulating blade during solid image printing and the amount of toner charge and the amount of post-black fogging. It can be understood from the graph that the charge is low during the first rotation immediately after printing the solid image (when the number of times the toner has passed the regulating blade is one time), and that the amount of post-black fogging decreases during the second rotation and beyond (when the number of times the toner passes the regulating blade is two or more) since the amount of charge stabilizes.

If the amount of post-black fogging is large, discharge between the charging roller and the photosensitive drum as well as rubbing of toner on the surface of the photosensitive drum are unable to be carried out adequately, causing toner to adhere to the charging roller and resulting in the risk of the photosensitive drum being unable to be uniformly charged by the charging roller. Furthermore, post-black fogging occurs particularly frequently during the latter half of the service life of the developing apparatus. This is because charging performance of the toner decreases due to release of external additives from the toner or external additives becoming embedded in the toner due to rubbing with the photosensitive drum or regulating blade during the latter half of the service life of the developing apparatus.

In a configuration that uses a cleaner-less system as described above, there are cases in which post-black fogging toner, which has adhered to the photosensitive drum and to which a charge has not been adequately imparted by rubbing between the charging roller and photosensitive drum, adheres to the charging roller. This toner migrates to the photosensitive drum as a result of reaching the location where it again opposes the photosensitive drum due to rotation of the charging roller, and eventually reaches the location opposing the developing apparatus due to further rotation of the photosensitive drum. The toner is then collected to the developing apparatus. However, if post-black fogging is also present on the photosensitive drum when toner adhered to the charging roller has returned to the location opposing the photosensitive drum, toner is unable to migrate from the charging roller to the photosensitive drum. Conversely, toner on the photosensitive drum may adhere to the charging roller, thereby further resulting in the risk of soiling the charging roller. In such cases, there is the possibility of it being difficult to uniformly charge the photosensitive drum with the charging roller.

Therefore, an object of the present invention is to reduce uneven charging of an image bearing member.

In order to achieve the above-mentioned object, the image forming apparatus according to the present invention, comprising:

a rotatable image bearing member;

a charging member that is provided so as to be able to rotate while contacting the image bearing member and charges the image bearing member;

a developer bearing member that is provided so as to be able to rotate while contacting the image bearing member, that supplies developer to the image bearing member and that collects the developer remaining on the image bearing member after a developer image formed on the image bearing member is transferred to a recording material; and, wherein if an outer diameter of the charging member is defined as Hc, a ratio of a circumferential velocity of the charging member to a circumferential velocity of the image bearing member is defined as Rc, an outer diameter of the developer bearing member is defined as Hd, and a ratio of a circumferential velocity of the developer bearing member to the circumferential velocity of the image bearing member is defined as Rd, a relationship:

$$Hc/Rc \geq Hd/Rd$$

is satisfied.

According to the present invention, uneven charging of an image bearing member can be reduced.

Further features of the present invention will become apparent from the following description of exemplary embodiments with reference to the attached drawings.

BRIEF DESCRIPTION OF THE DRAWINGS

FIGS. 3A to 3F are schematic diagrams showing an example of the migration of toner from development to collection by a developing roller;

DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments.

<Configuration of Image Forming Apparatus>

Figure 1:
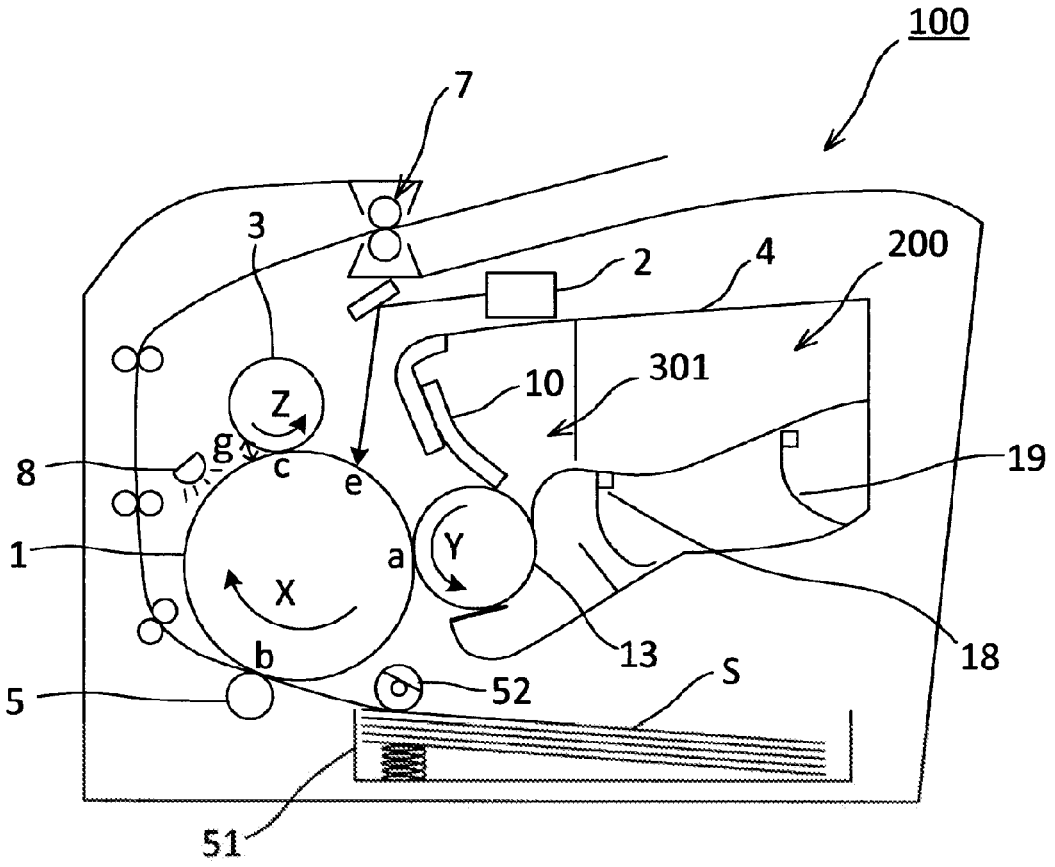
FIG. 1 is a schematic sectional view showing the configuration of an image forming apparatus according to the present example.

First, an explanation is provided of the configuration and image forming operation of the image forming apparatus according to an example of the present invention (present example) with reference to FIG. 1. FIG. 1 is a schematic cross-sectional view showing the configuration of an image forming apparatus according to the present example. An image forming apparatus 100 according to the present example has, for the main configuration thereof, an image bearing member in the form of a photosensitive drum 1, a laser beam scanner 2, a charging member in the form of a charging roller 3, a developing apparatus 4, a transfer member in the form of a transfer roller 5, and a fixing apparatus 7.

The image forming apparatus 100 receives an image information signal from a personal computer and the like not shown, and transports a recording material in the form of a sheet S from a sheet cassette 51 installed in the lower portion of the apparatus to a transport roller 52. Rotation and driving of the photosensitive drum 1 begin in synchronization with this sheet transport. The photosensitive drum is an OPC photosensitive body having a diameter of 24 mm and negative polarity. This photosensitive drum 1 is rotated and driven at a constant circumferential velocity of 100 mm/sec (which is equal to the process speed PS or printing speed) in the direction indicated by arrow X in FIG. 1.

The charging roller 3 is provided so as to be able to rotate while contacting the photosensitive drum 1 and charge the surface of the photosensitive drum 1. The charging roller 3 is an electrically conductive elastic roller that is composed of a core metal and an electrically conductive elastic layer, and contacts the photosensitive drum 1 at a prescribed pressing force. The location on the surface of the photosensitive drum 1 that contacts the charging roller 3 is designated as a charging zone c. The surface of the photosensitive drum 1 is charged by the charging roller 3 in this charging zone c.

In the present example, the charging roller 3 is driven to rotate in the direction indicated by arrow Z in FIG. 1. A charging bias is applied to the charging roller 3 by a charging power supply not shown. In the present example, a direct current voltage is applied to the core metal of the charging roller 3 by the charging power supply. The applied direct current voltage is set to a value such that the potential difference between the surface potential of the photosensitive drum 1 and the surface potential of the charging roller 3 is equal to or greater than discharge starting voltage, and more specifically, a direct current voltage of −1300 V is applied as charging bias. At this time, the surface of the photosensitive drum 1 is uniformly contacted and charged to a charging potential (dark potential) of −700 V.

The laser beam scanner 2 is an exposure means that includes a laser diode, polygon mirror and the like, and forms an electrostatic latent image by exposing the surface of the photosensitive drum 1 that has been charged by the charging roller 3. The laser beam scanner 2 outputs laser light for which intensity has been modulated corresponding to a time-series electro-digital pixel signal containing target image information, and scans and exposes the surface of the rotating photosensitive drum 1. Laser power is adjusted so that the surface potential of the photosensitive drum 1 is −150 V in the case in which the entire surface of the photosensitive drum 1 has been exposed to laser light.

Magnetic, one-component developer (to be simply referred to as magnetic toner or toner) is used as developer in the present example in the developing apparatus 4. Non-magnetic developer may also be used depending on the configuration. The developing apparatus 4 has a developer storage unit in the form of a storage chamber 200 that houses the magnetic toner, and a developing chamber 301, in which is arranged a developer carrier in the form of a developing roller 13. The magnetic toner is attracted to the developing roller 13 by the magnetic force of a magnetic field generation means in the form of a magnetic roller 14 (see FIG. 2) incorporated within the developing roller 13.

The magnetic toner is subjected to constant triboelectric charging, and migrates from the developing roller 13 to the photosensitive drum 1 due to developing bias applied between the developing roller 13 and the photosensitive drum 1 by a developing bias-applying power supply. The location on the surface of the photosensitive drum 1 where toner migrates from the developing roller 13 is designated as developing zone a. As a result of toner being supplied to the developing zone a, the developing roller 13 develops an electrostatic latent image on the photosensitive drum 1 and forms a developer image in the form of a toner image. Furthermore, developing bias is set to −350 V in the present example.

The transfer roller 5 is pressed against the photosensitive drum 1. The location on the surface of the photosensitive drum 1 contacted by the transfer roller 5 is designated as transfer zone b. In the present example, a transfer roller having a roller resistance value of $5\times10^{8}\Omega$ and having a medium resistance foam layer formed in the core metal thereof is used for the transfer roller 5. The transfer roller 5 transfers a toner image formed on the photosensitive drum 1 to a sheet S (recording material) by applying a voltage of +2.0 kV to the core metal.

The fixing apparatus 7 is a heat fixation type of fixing means. After the sheet S has passed the transfer zone b and been transferred with a toner image, it separates from the surface of the photosensitive drum 1 and is introduced into the fixing apparatus 7. In the fixing apparatus 7, the toner image is heated and fixed on the sheet S, after which the sheet S is discharged outside the apparatus in the form of a sheet having an image formed thereon (print copy).

<Cleaner-Less System>

Here, an explanation is provided of a cleaner-less system. In the present example, a so-called cleaner-less system is used that does not have a cleaning member that removes untransferred toner remaining on the photosensitive drum 1 after the transfer step from the photosensitive drum 1. Untransferred toner remaining on the photosensitive drum 1 after the transfer step migrates to a gap portion g upstream from the contact region (charging zone c) between the charging roller 3 and the photosensitive drum 1 in the direction of rotation X of the photosensitive drum 1. In the gap portion g, discharge occurs between the charging roller 3 and the photosensitive drum 1. Consequently, untransferred toner is charged to negative polarity, which is the same polarity as the photosensitive drum 1, by the discharge. At this time, the surface of the photosensitive drum 1 is charged to −700 V. The untransferred toner, which has been charged to negative polarity, passes the charging roller 3 in the charging zone c without adhering thereto. This is because there is a potential difference between the surface potential of the photosensitive drum 1 of −700 V and the surface potential of the charging roller 3 of −1300 V.

After having passed the charging zone c, untransferred toner reaches a laser irradiation location e on the surface of the photosensitive drum 1 that is irradiated with laser light by the laser beam scanner 2. Since the amount of untransferred toner is not so great so as to block laser light from the laser beam scanner 2, it does not have an effect on the step for forming an electrostatic latent image on the photosensitive drum 1. After having passed the laser irradiation location e, the toner is collected to the developing roller 13 by electrostatic force at the portion in the developing zone a that is not exposed to laser light (surface of the photosensitive drum 1 not subjected to laser radiation).

Toner at the exposed portion (surface of the photosensitive drum 1 subjected to laser radiation) is not collected by electrostatic force and remains present as is on the photosensitive drum 1. However, a portion of the toner is collected due to physical force attributable to the difference in circumferential velocity between the developing roller 13 and the photosensitive drum 1. Toner that has remained on the photosensitive drum 1 without being transferred to paper in this manner is for the most part collected to the developing apparatus 4. Toner that has been collected to the developing apparatus 4 is reused after being mixed with toner remaining in the developing apparatus 4.

In the present example, the following two configurations are used to allow untransferred toner to pass the charging zone c without adhering to the charging roller 3. In the first configuration, a neutralizing member in the form of a photoneutralizing member 8 is provided between the transfer zone b and the charging zone c in the direction of rotation of the photosensitive drum 1. The photoneutralizing member 8 photoneutralizes the surface potential of the photosensitive drum 1 after passing the transfer zone b in order to ensure stable discharge in the gap portion g upstream from the charging zone c. Due to this photoneutralizing member 8, discharge can be carried out uniformly and untransferred toner can be uniformly imparted with negative polarity as a result of the potential of the photosensitive drum 1 prior to charging made to be about −150 V over the entire lengthwise direction thereof.

In the second configuration, the charging roller 3 and the photosensitive drum 1 are driven and rotated by providing a prescribed difference in circumferential velocity between their respective circumferential velocities. Although much of the toner is imparted with negative polarity as a result of the discharge as described above, a small amount of toner remains that is not imparted with negative polarity, and this toner adheres to the charging roller 3 in the charging zone c. By driving and rotating the charging roller 3 and the photosensitive drum 1 by providing a prescribed difference in the circumferential velocities thereof, toner that has not been imparted with negative polarity can be imparted with negative polarity due to rubbing between the photosensitive drum 1 and the charging roller 3. Consequently, toner can be inhibited from adhering to the charging roller 3 in the charging zone c.

In the present example, a charging roller gear is provided in a core metal 2*a* of the charging roller 3, and the charging roller gear engages with a drum gear provided on the end of the photosensitive drum 1. Accordingly, the charging roller 3 is also rotated and driven accompanying rotation and driving of the photosensitive drum 1. The circumferential velocity of the charging roller 3 may be faster or slower than the circumferential velocity of the photosensitive drum 1. Moreover, the charging roller 3 and the photosensitive drum 1 may rotate in the forward direction or rotate in the reverse direction.

<Explanation of Developing Apparatus>

Figure 2:
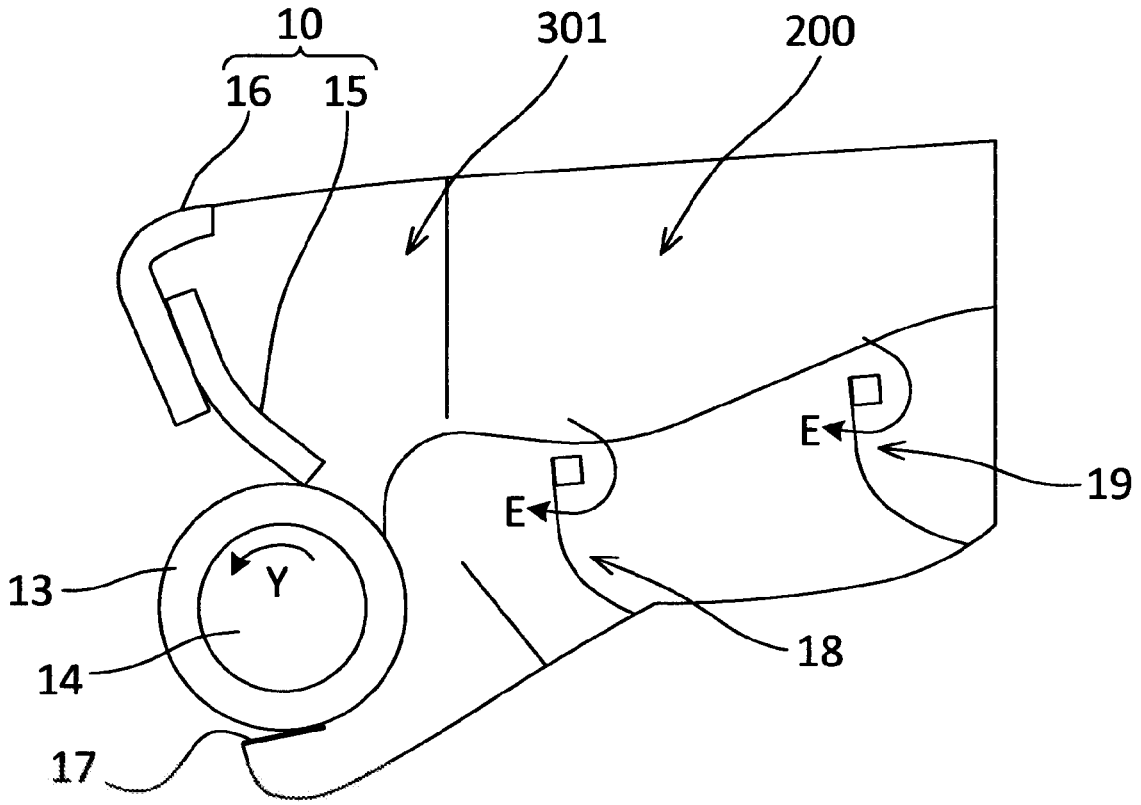
FIG. 2 is a schematic sectional view showing the configuration of a developing apparatus of the present example.

Next, a detailed explanation is provided of the developing apparatus of the present example with reference to FIG. 2. FIG. 2 is a schematic cross-sectional view showing the configuration of the developing apparatus of the present example. The developing apparatus 4 is provided with the toner storage chamber 200 that houses toner therein, and the developing chamber 301 that supplies toner to the photosensitive drum 1. Stirring members 18 and 19, which can be rotated in the direction of arrow E for transporting toner to the developing chamber 301, are provided in the toner storage chamber 200. The developing chamber 301 has an opening in the lower portion of the front side thereof (left side in FIG. 2), and a developer carrier in the form of the developing roller 13 is arranged therein.

A negatively charged, magnetic, one-component toner is used for the toner housed in the toner storage chamber 200. This toner is obtained by incorporating 80 parts by weight of a main component in the form of magnetic body particles as well as wax and other components in 100 parts by weight of a binder resin (styrene-n-butylacrylate copolymer), and has a mean particle diameter of 7.5 μm. In addition, 1.2 parts by weight of silica fine powder is used as an external additive.

The developing roller 13 is obtained by forming an electrically conductive elastic layer having a thickness of about 500 μm around the periphery of a non-magnetic sleeve formed from an aluminum or stainless steel pipe, and is supported while allowing to rotate freely in the direction of arrow Y by the frame body that composes the developing chamber 301. The surface of the developing roller 13 has a suitable surface roughness so as to be able to retain and transport a desired amount of toner. More specifically, the developing roller 13 is formed so that the surface roughness thereof in terms of Ra as defined in JIS standards is about 2.5 μm to 3.5 μm as the average of the circumferential direction and lengthwise direction.

In addition, the developing roller 13 is pressed in the direction of the photosensitive drum 1 so as to contact the photosensitive drum 1. Penetration level-regulating rollers are arranged on both ends of the developing roller 13 in the lengthwise direction thereof (axial direction), and as a result of these rollers contacting the photosensitive drum 1, the penetration level between the developing roller 13 and the surface of the photosensitive drum 1 is regulated to a prescribed value. In addition, a developing roller gear is fixed to one end of the developing roller 13, and the developing roller 13 is rotated and driven as a result of driving force being transmitted from a drive source of the image forming apparatus body to this developing roller gear through a plurality of gears.

In addition, the magnetic roller 14 is arranged inside the developing roller 13. A 4-pole magnetic roller having a cylindrical shape in which the N poles and S poles are alternately arranged in the circumferential direction thereof is used for the magnetic roller 14. The 4 poles are formed of a development pole of the opposing portion of the photosensitive drum 1, a regulating pole opposing the contact region of the regulating blade 10 to be subsequently described, a supply pole for supplying toner in the developing chamber 301 to the developing roller 13, and a leakage prevention pole of the opposing portion of a toner leakage-preventing sheet 17. The flux density of each pole is such that the flux density of the regulating pole is the greatest at 70 mT, while that of the other poles is about 50 mT. Differing from the developing roller 13 rotating in the direction of arrow Y, the magnetic roller 14 is arranged fixed inside the developing roller 13.

A charge-imparting member in the form of the regulating blade 10 contacts the surface of the above-mentioned developing roller 13. The regulating blade 10 is composed of an elastic member 15 and a supporting metal plate 16 that supports the elastic member 15 and is fixed to the frame body that composes the developing chamber 301. The elastic member 15 is in the shape of a sheet that is formed from, for example, stainless steel (SUS) or phosphor bronze and the like having a thickness of about 100 μm, and in addition to the proximal end thereof being fixed to the supporting metal plate 16, the distal end thereof is pressed against the surface of the developing roller 13 at a prescribed pressure. The regulating blade 10 contacts the developing roller 13 such that the contact force of the regulating blade 10 with respect to the developing roller 13 is about 20 gf/cm to 40 gf/cm (contact load per cm in the lengthwise direction of the developing roller 13). In the present example, the tip of the free end of the regulating blade 10 contacts the developing roller. This regulating blade 10 serves to regulate the thick layer of toner attracted to the surface of the developing roller 13 by the magnetic force of the above-mentioned magnetic roller 14. In the case of using the toner described above, the amount of toner coated onto the developing roller 13 is about 0.4 mg/cm$^2$ to 0.5 mg/cm$^2$.

Toner retained on the surface of the developing roller 13 is imparted with a suitable charge due to triboelectric charging attributable to rubbing between the developing roller 13 and the regulating blade 10 when layer thickness is regulated by the regulating blade 10. Subsequently, the toner that has been imparted with a charge is transported to the developing zone a due to rotation of the developing roller 13. At this time, developing bias (about −400 V) is applied to the developing roller 13 from a direct current power supply. In the developing zone a, toner on the developing roller 13 electrostatically adheres to an electrostatic latent image formed on the surface of the photosensitive drum 1 due to a potential difference between the surface potential of the photosensitive drum 1 and the surface potential of the developing roller 13. An electrostatic latent image is developed as a toner image in this manner.

<Post-Black Fogging>

Figure 6:
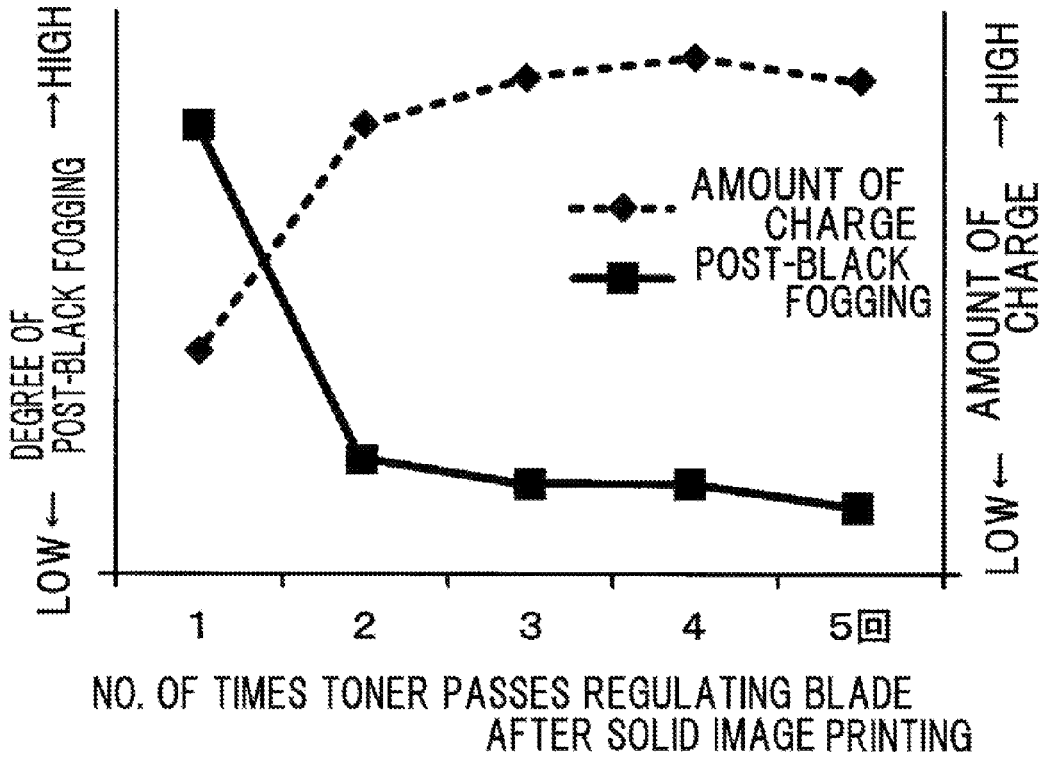
FIG. 6 is a graph indicating the relationship between the number of times toner passes over a regulating blade and the amount of charge and degree of post-black fogging.

Next, an explanation is provided of post-black fogging. In the case of forming a solid image, for example, nearly 100% of toner on the developing roller 13 migrates to the photosensitive drum 1. Here, since toner adhered to the developing roller immediately after forming the solid image is only rubbed once by the regulating blade 10, there are cases in which it is not imparted with an adequate charge. There are cases in which a phenomenon ends up occurring in which toner that has not been imparted with an adequate charge migrates to the area of a white background of the photosensitive drum 1. In this manner, adhesion of toner to the photosensitive drum 1 that occurs after forming a solid image is referred to as post-black fogging. Post-black fogging is a phenomenon that occurs immediately after printing, but does not occur during printing. Although post-black fogging occurs over the width of the printing pattern in the case in which the printing pattern is shorter than one rotation of the developing roller 13, in the case of having developed the printing pattern for one rotation of the developing roller 13 or more, post-black fogging occurs for one rotation of the developing roller 13. This is because toner on the developing roller 13 that has been rubbed two or more times by the regulating blade 10 due to rotation of the developing roller 13 has difficulty in migrating to the photosensitive drum 1 due to post-black fogging (see FIG. 6).

Moreover, a detailed explanation is provided of the occurrence of post-black fogging with reference to FIGS. 3A to 3F. FIGS. 3A to 3F are schematic diagrams indicating an example of the migration of toner by the developing roller from development to collection. FIGS. 3A to 3F indicate an example of the case in which printing is not carried out immediately after having formed a solid image (in the case of a white background) and the lengths of the developing roller pitch and charging roller pitch are equal. Here, developing roller pitch refers to the length of one rotation of the developing roller 13 with respect to the surface of the photosensitive drum 1, while charging roller pitch refers to the length of one rotation of the charging roller 3 with respect to the surface of the photosensitive drum 1.

The developing roller pitch and the charging roller pitch are determined by their respective outer diameter and circumferential velocity ratio (proportion) with respect to the photosensitive drum 1. If the outer diameter of the developing roller 13 is taken to be Hd and the circumferential velocity ratio of the developing roller 13 with respect to the photosensitive drum 1 is taken to be Rd, then the developing roller pitch is expressed as $Hd\times\pi/Rd\times$(circumferential velocity of the photosensitive drum 1), where $\pi$ is the circle ratio. In addition, if the outer diameter of the charging roller 3 is taken to be Hc and the circumferential velocity ratio of the charging roller 3 to the photosensitive drum 1 is taken to be Rc, then the charging roller pitch is expressed as $Hc\times\pi/Rc\times$(circumferential velocity of the photosensitive drum 1). On the basis thereof, the relationship between developing roller pitch and charging roller pitch is equivalent to the relationship of Hd/Rd and Hc/Rc.

First, as shown in FIG. 3A, toner T is developed on the photosensitive drum 1 from the developing roller 13 in the developing zone a. Toner on the developing roller 13 immediately after development is rubbed once by the regulating blade 10 due to rotation of the developing roller 13 in the direction of arrow Y and reaches the developing zone a. The toner, which has not been imparted with an adequate charge as a result of being rubbed only once, migrates from the developing roller 13 to a white background portion of the photosensitive drum 1 in the developing zone a. Toner that has migrated to a white background portion of the photosensitive drum 1 becomes post-black fogging toner t. Adhesion of post-black fogging toner t to a white background portion on the photosensitive drum 1 in this manner constitutes the occurrence of the above-mentioned post-black fogging. Furthermore, the polarity of the post-black fogging toner t that has not been imparted with an adequate charge is positive (+) or has zero charge as shown in FIG. 3B.

Post-black fogging toner t reaches the transfer zone b by rotation of the photosensitive drum 1 in the direction of arrow X as shown in FIG. 3B. The post-black fogging toner t that has reached the transfer zone b is charged to positive polarity (+) by positive polarity voltage applied to the transfer roller 5.

The positively charged post-black fogging toner t passes the transfer zone b and reaches the charging zone c as shown in FIG. 3C due to rotation of the photosensitive drum 1 in the direction of arrow X. Here, the positively charged post-black fogging toner t is discharged in the gap portion g between the charging roller 3 and the photosensitive drum 1 causing it to have negative polarity, or it may have negative polarity due to rubbing of the charging roller 3 and the photosensitive drum 1. However, a portion of the post-black fogging toner t is not negative charged, causing it to migrate from the photosensitive drum 1 to the charging roller 3 (onto the charging roller) in the charging zone c. That state is shown in FIG. 3D. Furthermore, in FIG. 3D, post-black fogging toner having negative polarity that remains on the photosensitive drum 1 is omitted from the drawing. The post-black fogging toner having negative polarity that remains on the photosensitive drum 1 reaches the developing zone a due to rotation of the photosensitive drum 1 where it is then collected to the developing roller 13 and reused.

Post-black fogging toner t adhered to the charging roller 3 returns to the charging zone c due to rotation of the charging roller 3 in the direction of arrow Z. Post-black fogging toner t that has returned to the charging zone c is discharged in the gap portion g between the charging roller 3 and the photosensitive drum 1 causing it to have negative polarity, or it may have negative polarity due to rubbing of the charging roller 3 and the photosensitive drum 1. The negatively charged post-black fogging toner t migrates from the charging roller 3 to the photosensitive drum 1 as shown in FIGS. 3E and 3F. Post-black fogging toner t that has migrated to the photosensitive drum 1 returns to the developing zone a due to rotation of the photosensitive drum 1 in the direction of arrow X. The post-black fogging toner t is then collected to the developing roller 13 and reused.

Moreover, an explanation is provided of uneven charging caused by the occurrence of post-black fogging. When post-black fogging toner that has adhered to the charging roller 3 again reaches the charging zone c due to rotation of the charging roller 3, defective charging occurs in the case in which post-black fogging is present on the photosensitive drum 1. As was previously described, post-black fogging toner adhered to the charging roller 3 again migrates to the photosensitive drum 1 in the charging zone c. At that time, if post-black fogging toner is adhered to the photosensitive drum 1, discharge in the gap portion g between the charging roller 3 and the photosensitive drum 1 is inadequate, and the toner may not be adequately rubbed by the charging roller 3 and the photosensitive drum 1. Consequently, post-black fogging toner on the charging roller 3 is unable to migrate to the photosensitive drum 1 even if it reaches the charging zone c, and ends up remaining adhered to the charging roller 3. Conversely, post-black fogging toner on the photosensitive drum 1 may end up further adhering to the charging roller 3. In this manner, if post-black fogging toner is adhered to the charging roller 3, charging of the photosensitive drum 1 by the charging roller 3 does not proceed uniformly resulting in the occurrence of uneven charging.

Example 1

The following provides an explanation of Example 1. In the configuration of Example 1, uneven charging caused by post-black fogging toner adhered to the charging roller 3 can be inhibited. In Example 1, developing roller pitch and charging roller pitch were made to be equal. Namely, Hc/Rc=Hd/Rd. More specifically, in Example 1, the outer diameter Hd of the developing roller 13 was made to be 12 mm and the circumferential velocity ratio Rd of the developing roller 13 to the photosensitive drum 1 was made to be 120%. In addition, the outer diameter Hc of the charging roller 3 was made to be 9 mm and the circumferential velocity ratio Rc of the charging roller 3 to the photosensitive drum 1 was made to be 90%.

In Example 1, a first round of post-black fogging occurs and that post-black fogging toner reaches the charging zone c due to rotation of the photosensitive drum 1. At that time, a portion of the post-black fogging toner that was not imparted with an adequate charge by discharge and rubbing adheres to the charging roller 3. Subsequently, the post-black fogging toner adhered to the charging roller 3 again reaches the charging zone c due to rotation of the charging roller 3.

In the configuration of Example 1, post-black fogging toner is not present on the photosensitive drum 1 when the post-black fogging toner on the charging roller 3 has again reached the charging zone c. In Example 1, since the developing roller pitch and charging roller pitch are equal, the trailing end of the post-black fogging toner adheres to the charging roller 3 in the charging zone c immediately before the leading end of the post-black fogging toner reaches the charging zone c again. In Example 1, since the charging roller pitch and developing roller pitch are equal, adhesion and collection can be repeated since post-black fogging toner does not continuously reach the same portion on the surface of the charging roller 3.

Although the present example has been explained on the premise that the length of post-black fogging is the same as the printing length or developing roller pitch, there are also cases in which this is not true. For example, post-black fogging has been determined to not occur unless developed over a certain length. One possible reason for this is that, toner, which is charged and retained when the layer thicknesses of a developed portion and non-developed portions before and after the developed portion are regulated by the regulating blade 10, is mixed together. Another reason is that, toner is present upstream from the contact region with the regulating blade 10 that retains charge that has remained following regulation of layer thickness. In this manner, the width over which post-black fogging does not occur varies according to the orientation and contact pressure of the regulating blade 10, the shape of the tip thereof (such as a step-shaped capturing portion), or the coated amount of toner retained on the developing roller 13. For example, there are cases in which post-black fogging is prevented from occurring for about 0.8 mm on the leading end and about 0.5 mm on the trailing end. In such cases, similar effects are obtained even if the charging roller pitch and the developing roller pitch are within about 1.3 mm.

Example 2

Next, an explanation is provided of Example 2. In Example 2, the charging roller pitch is made to be longer than the developing roller pitch. Namely, Hc/Rc>Hd/Rd. More specifically, in Example 2, the outer diameter Hd of the developing roller 13 is 12 mm and the circumferential velocity ratio Rd of the developing roller 13 to the photosensitive drum 1 is 140%. In addition, the outer diameter Hc of the charging roller 3 is 9 mm and the circumferential velocity ratio Rc of the charging roller 3 to the photosensitive drum 1 is 90%.

In the case of a long charging roller pitch, even in the case in which post-black fogging toner has been generated for one rotation of the developing roller 13, toner is not adhered over the entire circumference of the charging roller 3. Namely, the trailing end of the post-black fogging toner is on the charging roller 3 when the leading end of post-black charging toner adhered to the charging roller 3 has again reached the charging zone c. Consequently, when post-black fogging toner adhered to the charging roller 3 reaches the charging zone c, a charge is imparted due to discharge and rubbing, causing it to return to the photosensitive drum 1.

Figures 4A, 4B:
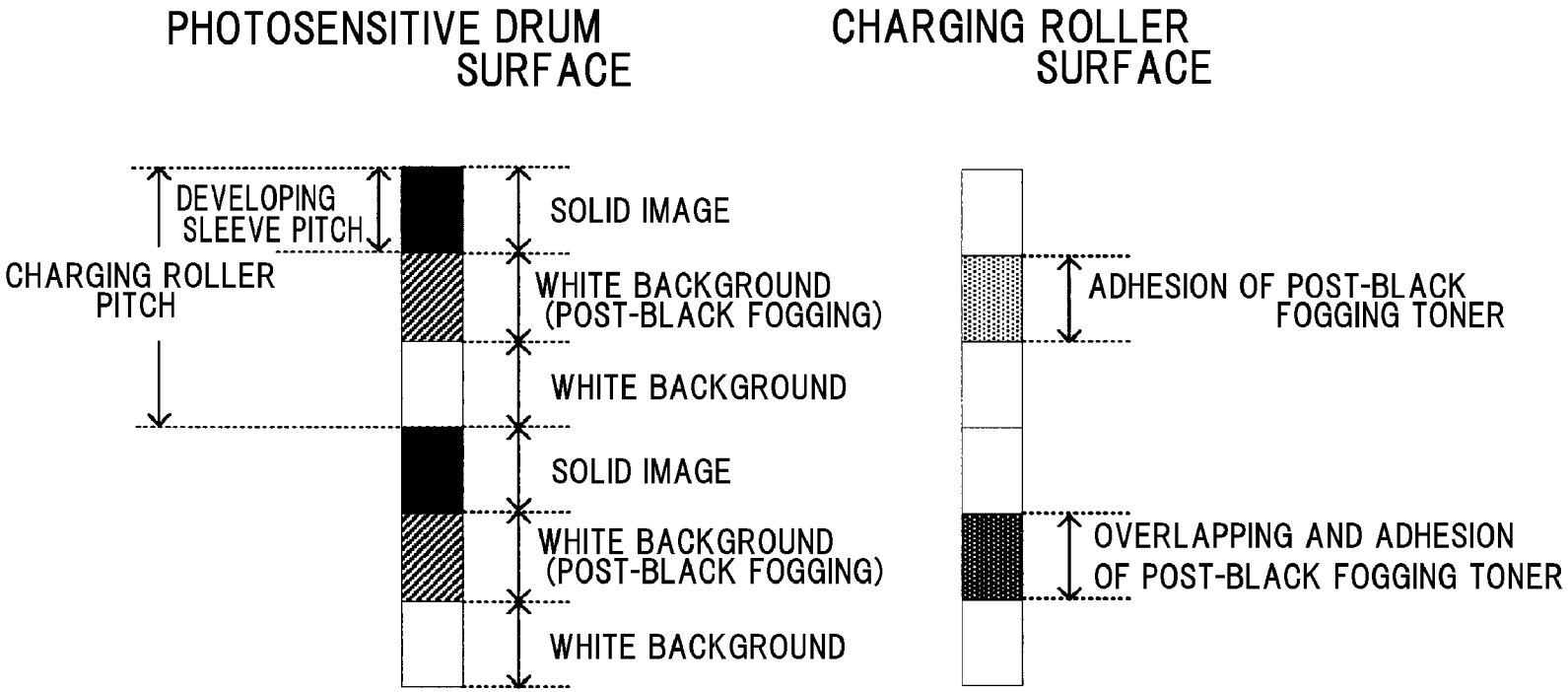
FIGS. 4A and 4B are drawings showing the status of the surface of a photosensitive drum and the status of the surface of a charging roller.

However, even in the case of satisfying the relationship of Hc/Rc>Hd/Rd, in the case in which a printing pattern is printed continuously at the pitch of the charging roller, there is the risk of the occurrence of uneven charging. An explanation of a case in which uneven charging occurs even in the case of satisfying the relationship of Hc/Rc>Hd/Rd is provided with reference to FIGS. 4A and 4B. FIG. 4A is a drawing indicating the surface status of a photosensitive drum, while FIG. 4B is a drawing indicating the surface status of a charging roller.

In FIG. 4A, the charging roller pitch is three times greater than the developing roller pitch. The printing pattern is formed of repetition of printing for one rotation of the developing roller pitch, printing a white background for one rotation of the developing roller pitch and printing a white background for one rotation of the developing roller. In such a case, as shown in FIG. 4B, the next post-black fogging toner reaches the charging zone c on the photosensitive drum 1 when the post-black fogging toner adhered to the charging roller 3 has returned to the charging zone c. Consequently, the post-black fogging toner overlaps in the charging zone c and the surface of the charging roller 3 ends up being soiled. Namely, in the case of satisfying the relationship of 3 (Hd/Rd)≥Hc/Rc≥Hd/Rd, it is thought to be difficult for soiling of the surface of the charging roller 3 to occur. As has been previously explained, in the configuration of Example 2, defective charging may occur depending on the printing pattern. However, it is rare for such printing patterns to occur.

Figures 5A, 5B, 5C, 5D:
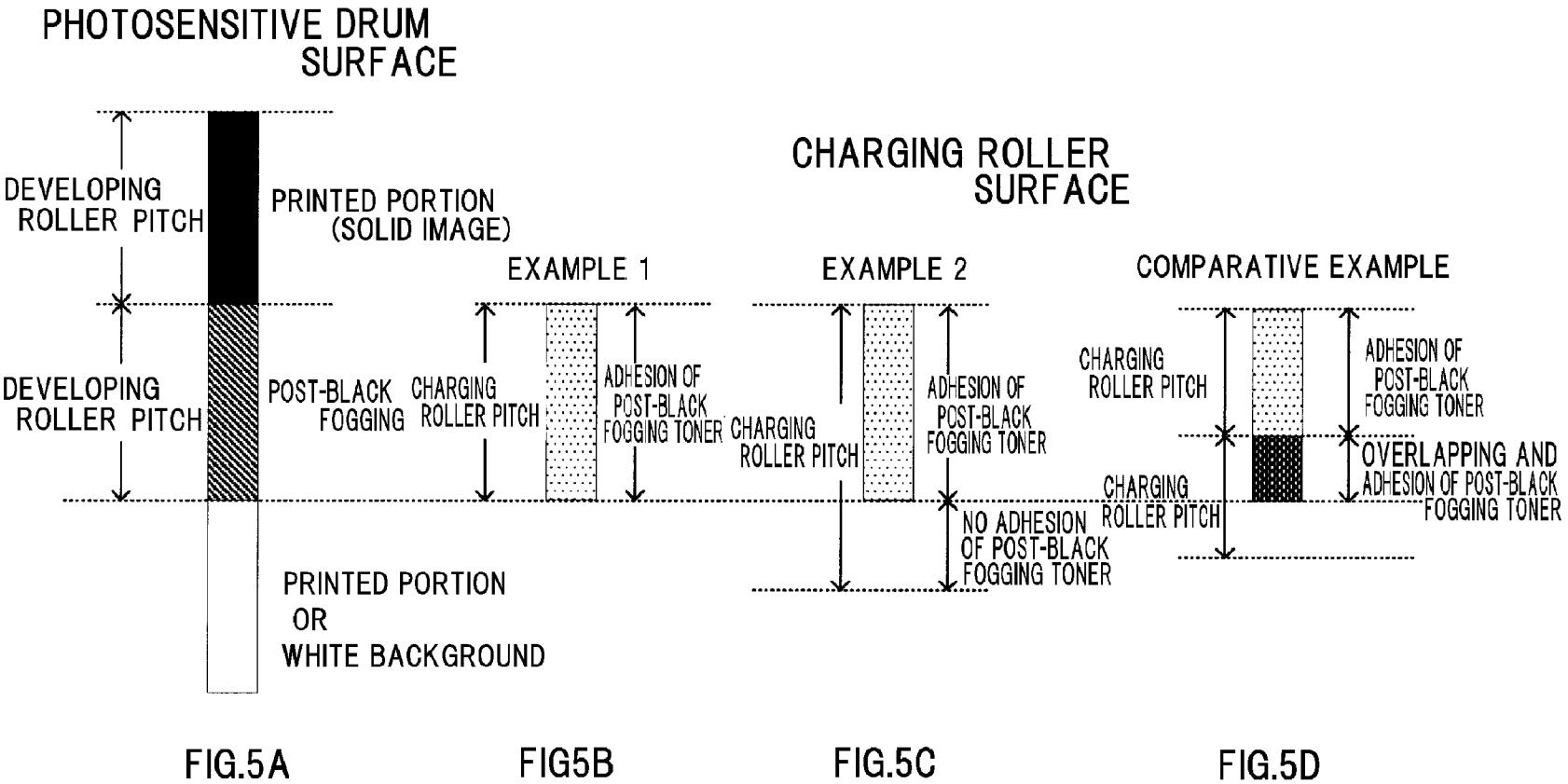
FIGS. 5A to 5D are drawings showing the status of the surface of a photosensitive drum and the status of the surface of a charging roller.

Moreover, an explanation is provided of Examples 1 and 2 and a comparative example with reference to FIGS. 5A to 5D. FIGS. 5A to 5D are drawings indicating the surface status of a photosensitive drum and the surface status of a charging roller. FIG. 5A is a drawing indicating the surface status of the photosensitive drum 1 in the case in which post-black fogging has occurred for one rotation of the developing roller (equal to the developing roller pitch). FIGS. 5B to 5D are drawings indicating the surface status of a charging roller in the case in which post-black fogging has occurred for one rotation of a developing roller (equal to the developing roller pitch). As was previously described, charging roller pitch and developing roller pitch were made to be equal in Example 1, while charging roller pitch was made to be longer than developing roller pitch in Example 2.

As shown in FIG. 5B, in Example 1, post-black fogging is not present on the photosensitive drum 1 when post-black fogging toner adhered to the charging roller 3 again returned to the charging zone c as a result of the charging roller 3 making one rotation. Consequently, uneven charging does not occur. Similarly, as shown in FIG. 5C, post-black fogging is not present on the photosensitive drum 1 when post-black fogging toner adhered to the charging roller 3 again returned to the charging zone c as a result of the charging roller 3 making one rotation in Example 2 as well. Consequently, uneven charging does not occur.

Here, in a comparative example, the charging roller pitch was made to be shorter than the developing roller pitch. Namely, Hc/Rc<Hd/Rd. More specifically, in the comparative example, the outer diameter Hd of the developing roller 13 is 12 mm and the circumferential velocity ratio Rd of the developing roller 13 to the photosensitive drum 1 is 120%. In addition, the outer diameter Hc of the charging roller 3 is 9 mm and the circumferential velocity ratio Rc of the charging roller 3 to the photosensitive drum 1 is 130%.

As shown in FIG. 5D, in the case the charging roller pitch is shorter than the developing roller pitch (length of post-black fogging), post-black fogging is also present on the photosensitive drum 1 when post-black fogging toner adhered to the charging roller 3 has again returned to the charging zone c. Consequently, post-black fogging toner on the charging roller 3 and post-black fogging toner on the photosensitive drum 1 end up reaching the charging zone c at the same time causing them to overlap. Consequently, there are cases in which post-black fogging toner adhered during the first rotation of the charging roller 3 is unable to return to the surface of the photosensitive drum 1 by discharge and rubbing, and therefore ends up further adhering to the charging roller 3. If post-black fogging toner ends up being continuously adhered to the charging roller 3 in this manner, charging performance decreases and the surface of the photosensitive drum 1 cannot be charged to a desired potential. As a result, uneven charging ends up occurring.

As can be understood from the above-mentioned Examples 1 and 2 and the comparative example, uneven charging can be effectively inhibited by making the charging roller pitch equal to or greater than the developing roller pitch. However, the charging roller pitch and developing roller pitch are most preferably made to be roughly equal as explained in Example 1. Furthermore, although the effects of the present invention can be obtained if Hc/Rd Hd/Rd, Hc/Rc is preferably three times Hd/Rd or less. Namely, the relationship of 3(Hd/Rd)≥Hc/Rc≥Hd/Rd is preferably satisfied. In addition, although a contact-type developing apparatus 4 that uses magnetic, one-component toner was used in Examples 1 and 2, the developing apparatus is not limited thereto, but rather similar effects are obtained in the case of the occurrence of post-black fogging even when using a contact developing apparatus that uses non-magnetic, one-component toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-122463, filed on Jun. 13, 2014, which is hereby incorporated by reference herein in its entirety.

What is claimed is:

1. An image forming apparatus, comprising:

an image bearing member;

a charging member that is configured to rotate while contacting the image bearing member and charge the image bearing member; and a developer bearing member that is configured to rotate while contacting the image bearing member and supply developer to the image bearing member, and that collects the developer remaining on the image bearing member after a developer image formed on the image bearing member is transferred to a recording material, wherein the image bearing member and the charging member move in a same direction at a first contact portion between the image bearing member and the charging member, wherein the image bearing member and the developer bearing member move in a same direction at a second contact portion between the image bearing member and the developer bearing member, and wherein if an outer diameter of the charging member is defined as Hc, a ratio of a circumferential velocity of the charging member to a circumferential velocity of the image bearing member is defined as Rc, an outer diameter of the developer bearing member is defined as Hd, and a ratio of a circumferential velocity of the developer bearing member to the circumferential velocity of the image bearing member is defined as Rd, a relationship:

$$Hc/Rc \geq Hd/Rd$$

is satisfied.

2. The image forming apparatus according to claim 1, wherein 3(Hd/Rd)≥Hc/Rc≥Hd/Rd is satisfied.

3. The image forming apparatus according to claim 1, wherein Hc/Rc=Hd/Rd is satisfied.

4. The image forming apparatus according to claim 1, wherein the circumferential velocity of the developer bearing member and the circumferential velocity of the image bearing member are different.

5. The image forming apparatus according to claim 1, wherein the circumferential velocity of the charging member and the circumferential velocity of the image bearing member are different.

6. The image forming apparatus according to claim 1, wherein the circumferential velocity of the charging member is faster than the circumferential velocity of the image bearing member.

7. The image forming apparatus according to claim 1, further comprising a developing apparatus provided with the developer bearing member and a developer storage unit that houses the developer supplied to the developer bearing member and the developer collected by the developer bearing member.

8. The image forming apparatus according to claim 1, further comprising:

an exposure unit that forms an electrostatic latent image on the image bearing member by exposing the image bearing member charged by the charging member; and a transfer member that transfers, to the recording material, a developer image formed on the image bearing member as a result of the developer being supplied to the electrostatic latent image by the developer bearing member.

9. The image forming apparatus according to claim 8, further comprising a neutralizing member that is provided between the charging member and the transfer member in a direction of rotation of the image bearing member and that neutralizes the charge on the image bearing member.

10. The image forming apparatus according to claim 1, wherein the developer is one-component developer.

11. The image forming apparatus according to claim 1, further comprising a charge-imparting member that imparts a charge to the developer so that the developer is supplied from the developer bearing member to the image bearing member.

12. The image forming apparatus according to claim 1, wherein the developer is magnetic developer.

* * * * *